US011564035B1

(12) United States Patent
Ebenezer

(10) Patent No.: US 11,564,035 B1
(45) Date of Patent: Jan. 24, 2023

(54) ACTIVE NOISE CANCELLATION SYSTEM USING INFINITE IMPULSE RESPONSE FILTERING

(71) Applicant: Cirrus Logic International Semiconductor Ltd., Edinburgh (GB)

(72) Inventor: Samuel P. Ebenezer, Gilbert, AZ (US)

(73) Assignee: Cirrus Logic, Inc., Austin, TX (US)

( * ) Notice: Subject to any disclaimer, the term of this patent is extended or adjusted under 35 U.S.C. 154(b) by 15 days.

(21) Appl. No.: 17/468,990

(22) Filed: Sep. 8, 2021

(51) Int. Cl.
*H04R 3/00* (2006.01)
*G10K 11/178* (2006.01)
*H04R 3/02* (2006.01)

(52) U.S. Cl.
CPC ..... *H04R 3/02* (2013.01); *G10K 11/178* (2013.01); *H04R 2499/11* (2013.01)

(58) Field of Classification Search
CPC ..... H04R 1/1083; H04R 3/00; H04R 3/005; H04R 3/02; H04R 3/04; H04R 25/45; H04R 2203/00; H04R 2499/10; H04R 2499/11; G10K 11/175; G10K 11/178; G10K 11/1781; G10K 11/17813; G10K 11/17815; G10K 11/17817; G10K 11/17819; G10K 11/17879; G10K 11/17881; G10K 11/17885
See application file for complete search history.

(56) References Cited

U.S. PATENT DOCUMENTS 9,076,431 B2 * 7/2015 Kamath ..... G10K 11/17881
9,578,415 B1 * 2/2017 Zhou ..... G10K 11/17823
9,950,213 B2 * 4/2018 Skulman ..... A63B 24/0075
11,189,261 B1 * 11/2021 Lu ..... G10K 11/17881
11,468,873 B2 * 10/2022 Cho ..... G10K 11/17881
2007/0076896 A1 * 4/2007 Hosaka ..... G10K 11/17854 381/71.11

(Continued)

*Primary Examiner* — Thang V Tran

(74) *Attorney, Agent, or Firm* — Jackson Walker L.L.P.

(57) ABSTRACT

An integrated circuit for implementing at least a portion of a personal audio device may include an output for providing a signal to a transducer including both a source audio signal for playback to a listener and an anti-noise signal for countering the effects of ambient audio sounds in an acoustic output of the transducer, a reference microphone input for receiving a reference microphone signal indicative of the ambient audio sounds, an error microphone input for receiving an error microphone signal indicative of the output of the transducer and the ambient audio sounds at the transducer, and a processing circuit configured to implement an adaptive infinite impulse response filter having a response that generates the anti-noise signal to reduce the presence of the ambient audio sounds at the error microphone and implement a coefficient control block that shapes the response of the adaptive infinite impulse response filter in conformity with the error microphone signal by generating coefficients that determine the response of the adaptive infinite impulse response filter in order to minimize the ambient audio sounds at the error microphone, wherein the coefficient control block selects the coefficients from a library of filter entries, each filter entry of the library of filter entries defining a respective response for the adaptive infinite impulse response filter.

28 Claims, 6 Drawing Sheets

(56) References Cited

U.S. PATENT DOCUMENTS

| | | | | |
|---|---|---|---|---|
| 2011/0158419 | A1* | 6/2011 | Theverapperuma | H04R 1/1083 381/71.1 |
| 2011/0222698 | A1* | 9/2011 | Asao | G10K 11/17881 381/71.1 |
| 2014/0270223 | A1* | 9/2014 | Li | H04R 3/002 381/71.6 |
| 2016/0196819 | A1* | 7/2016 | Wurtz | G10K 11/17854 381/94.3 |
| 2019/0378491 | A1* | 12/2019 | Mohammad | G10K 11/17823 |

* cited by examiner

ACTIVE NOISE CANCELLATION SYSTEM USING INFINITE IMPULSE RESPONSE FILTERING

FIELD OF DISCLOSURE

The present disclosure relates in general to active noise cancellation in connection with an acoustic transducer, and more particularly, to an active noise cancellation (ANC) system using infinite impulse response (IIR) filtering in order to minimize power consumption.

BACKGROUND

Wireless telephones, such as mobile/cellular telephones, cordless telephones, and other consumer audio devices, such as mp3 players, are in widespread use. Performance of such devices with respect to intelligibility can be improved by providing noise cancelling using a microphone to measure ambient acoustic events and then using signal processing to insert an anti-noise signal into the output of the device to cancel the ambient acoustic events.

An active noise cancellation (ANC) system achieves the suppression of noise by observing the ambient noise with one or more microphones and processing the noise signal with digital filters to generate an anti-noise signal, which is then played through a loudspeaker. The application of active noise cancellation to personal audio devices such as wireless telephones and headphones is intended to enhance the users' listening experience with respect to intelligibility and isolation from the ambient noise. Because the acoustic environment around personal audio devices can change depending on the noise sources that are present and the position or fitting condition of the device itself, an active noise cancellation system can be implemented with adaptive filters in order to adapt the anti-noise to take such environmental changes into account.

However, adaptive filters used on ANC often require a very high sampling rate in order to minimize latency. In addition, the required number of coefficients in a filter's impulse response may be large, which may require a large amount of power consumption. Infinite impulse response (IIR) filters may be used in order to minimize power consumption. However, the use of IIR filters in ANC comes with numerous challenges.

For example, design of IIR filter coefficients is not trivial, due to the fact that the bandwidth of interest (e.g., the human-perceptible audio bandwidth between 100 Hz and 3 KHz) is much smaller than the sampling frequency (e.g., 1.536 MHz). Further, traditional IIR filter design approaches such as using Gauss-Newton, Steiglitz-McBride, and Prony's methods may be ineffective and lead to instability. In addition, to be effective, the filter order of IIR filters must not be too high. Moreover, for optimal ANC performance, it may be desirable that the magnitude and phase response of the filter be very closely matched (e.g., within 0.5 decibels) in the frequency range of interest. Also, the target filter response may be valid only at a certain frequency range, and the IIR filter must be designed such that ANC boosting does not occur in the out-of-band frequency range. Likewise, an ANC system may require a stable and causal filter, and IIR filters are often prone to instability.

SUMMARY

In accordance with the teachings of the present disclosure, one or more disadvantages and problems associated with existing approaches to active noise cancellation may be reduced or eliminated.

In accordance with embodiments of the present disclosure, an integrated circuit for implementing at least a portion of a personal audio device may include an output for providing a signal to a transducer including both a source audio signal for playback to a listener and an anti-noise signal for countering the effects of ambient audio sounds in an acoustic output of the transducer, a reference microphone input for receiving a reference microphone signal indicative of the ambient audio sounds, an error microphone input for receiving an error microphone signal indicative of the output of the transducer and the ambient audio sounds at the transducer, and a processing circuit configured to implement an adaptive infinite impulse response filter having a response that generates the anti-noise signal to reduce the presence of the ambient audio sounds at the error microphone and implement a coefficient control block that shapes the response of the adaptive infinite impulse response filter in conformity with the error microphone signal by generating coefficients that determine the response of the adaptive infinite impulse response filter in order to minimize the ambient audio sounds at the error microphone, wherein the coefficient control block selects the coefficients from a library of filter entries, each filter entry of the library of filter entries defining a respective response for the adaptive infinite impulse response filter.

In accordance with these and other embodiments of the present disclosure, a method may include generating a signal to a transducer including both a source audio signal for playback to a listener and an anti-noise signal for countering the effects of ambient audio sounds in an acoustic output of the transducer, receiving a reference microphone signal indicative of the ambient audio sounds, receiving an error microphone signal indicative of the output of the transducer and the ambient audio sounds at the transducer, implementing an adaptive infinite impulse response filter having a response that generates the anti-noise signal to reduce the presence of the ambient audio sounds at the error microphone, and implementing a coefficient control block that shapes the response of the adaptive infinite impulse response filter in conformity with the error microphone signal by generating coefficients that determine the response of the adaptive infinite impulse response filter in order to minimize the ambient audio sounds at the error microphone, wherein the coefficient control block selects the coefficients from a library of filter entries, each filter entry of the library of filter entries defining a respective response for the adaptive infinite impulse response filter.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that may be implemented in a personal audio device, such as a wireless telephone or portable music player. The personal audio device may include an ANC circuit that may measure the ambient acoustic environment and generate a signal that is injected in the speaker (or other transducer) output to cancel ambient acoustic events. An error microphone may be included for controlling the adaptation of the anti-noise signal to cancel the ambient audio sounds and for correcting for the electro-acoustic path from the output of the processing circuit through the transducer.

Figure 1A:
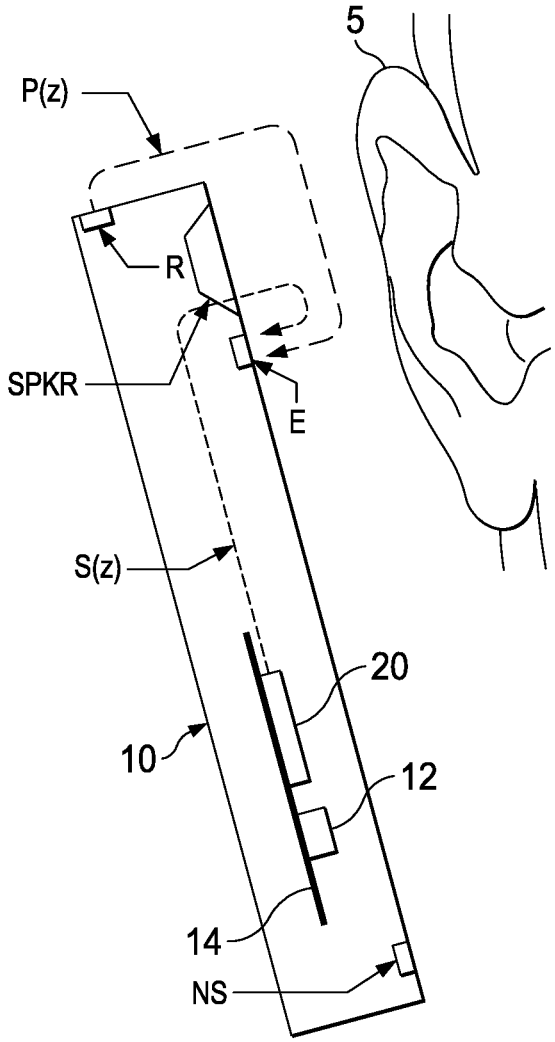
FIG. 1A is an illustration of an example personal audio device, in accordance with embodiments of the present disclosure.

Referring now to FIG. 1A, a personal audio device 10 as illustrated in accordance with embodiments of the present disclosure is shown in proximity to a human ear 5. Personal audio device 10 may include a mobile telephone, smart phone, music playback device, hearing aid or other hearing assistance device, and/or any other suitable device. Personal audio device 10 is an example of a device in which techniques in accordance with embodiments of this disclosure may be employed, but it is understood that not all of the elements or configurations embodied in illustrated personal audio device 10, or in the circuits depicted in subsequent illustrations, are required in order to practice the embodiments of the present disclosure recited in the claims. Personal audio device 10 may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when personal audio device 10 is in close proximity to ear 5. In other embodiments, additional reference and/or error microphones may be employed. Circuit 14 within personal audio device 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of personal audio device 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. While the illustrated personal audio device 10 includes a two-microphone ANC system with a third near-speech microphone NS, some aspects of the embodiments of the present disclosure may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
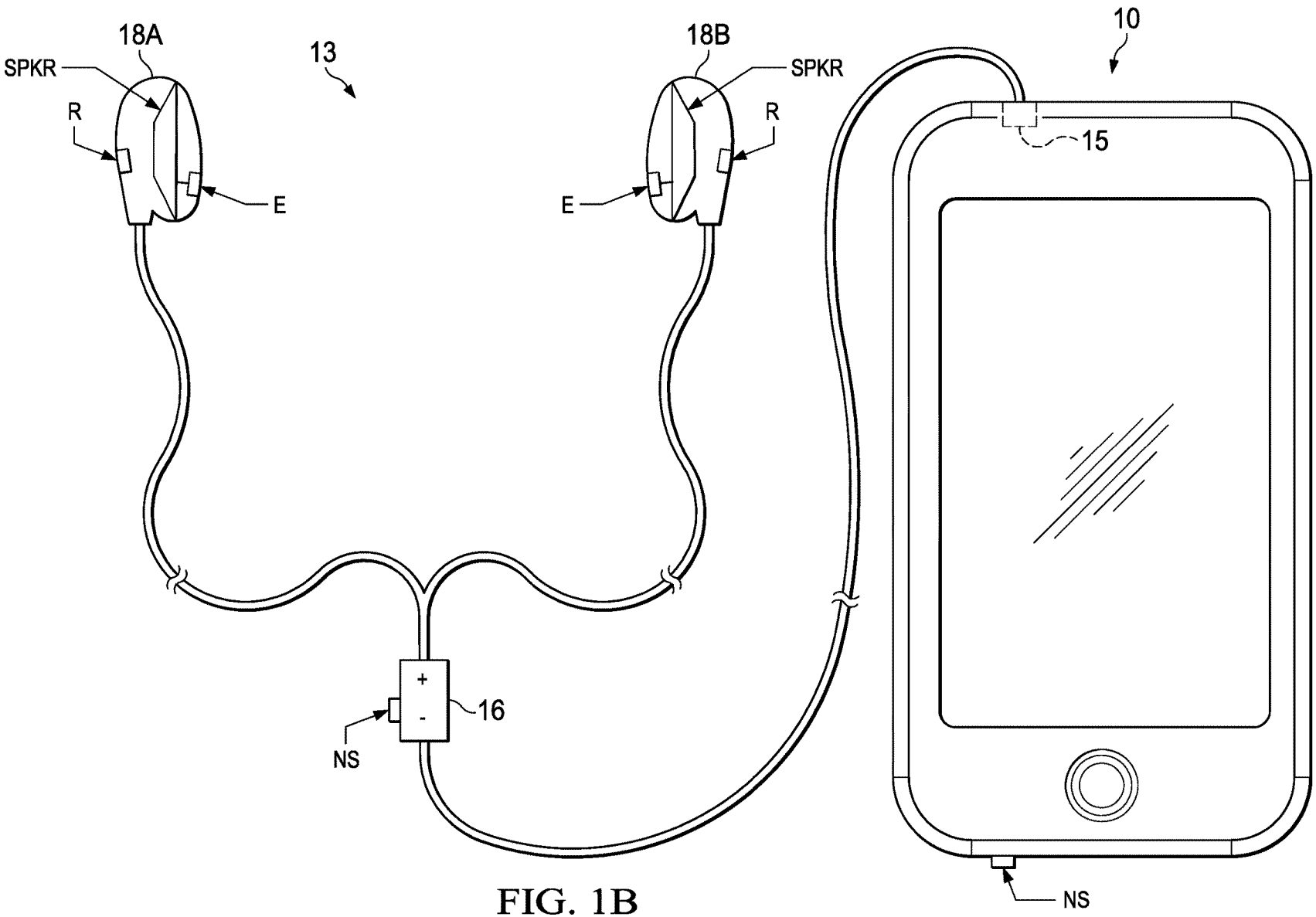
FIG. 1B is an illustration of an example personal audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and personal audio device 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R and error microphone E of each headphone and near-speech microphone NS, and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
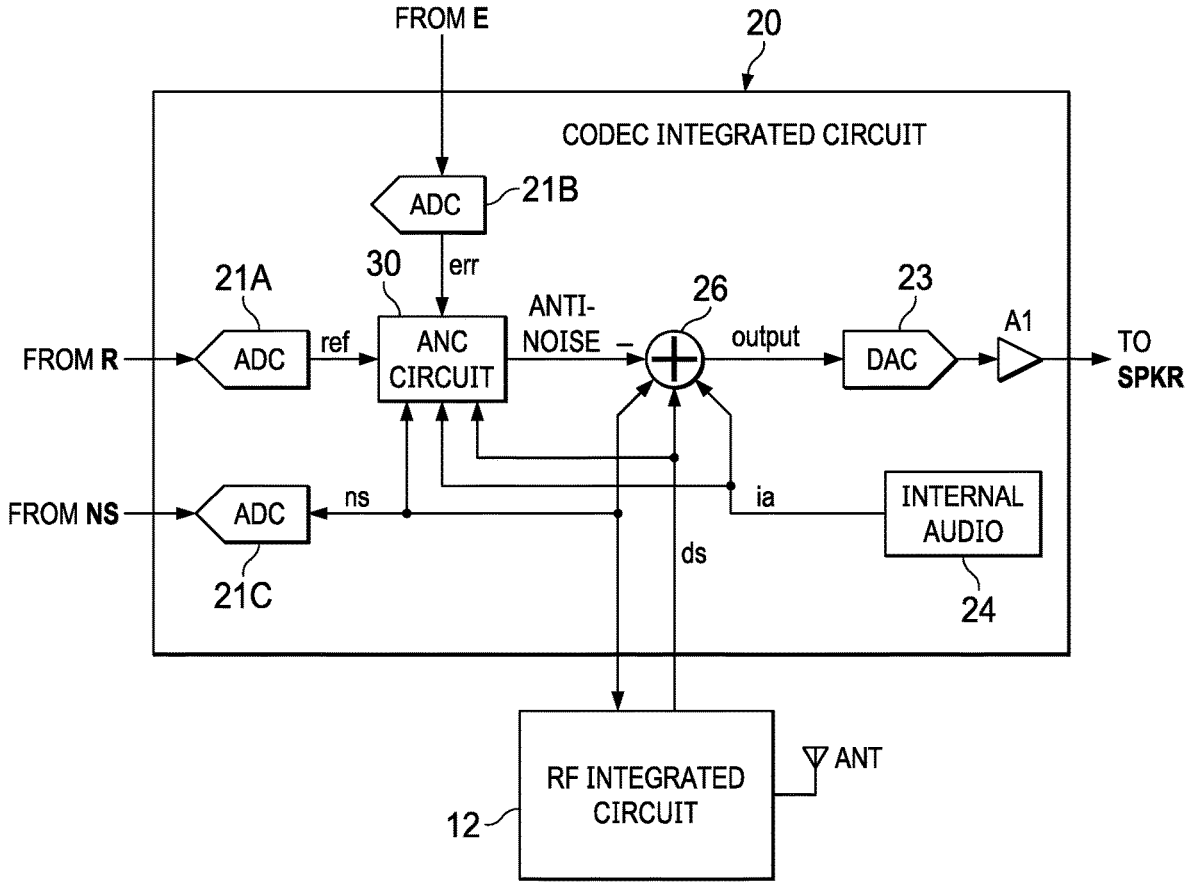
FIG. 2 is a block diagram of selected circuits within the personal audio device depicted in FIG. 1A, in accordance with embodiments of the present disclosure.

Referring now to FIG. 2, selected circuits within personal audio device 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from error microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of personal audio device 10 may hear his or her own voice in proper relation to downlink speech ds, which may be received from radio frequency (RF) integrated circuit 12 and may also be combined by combiner 26. Near speech microphone signal ns may also be provided to RF integrated circuit 12 and may be transmitted as uplink speech to the service provider via antenna ANT.

Figure 3:
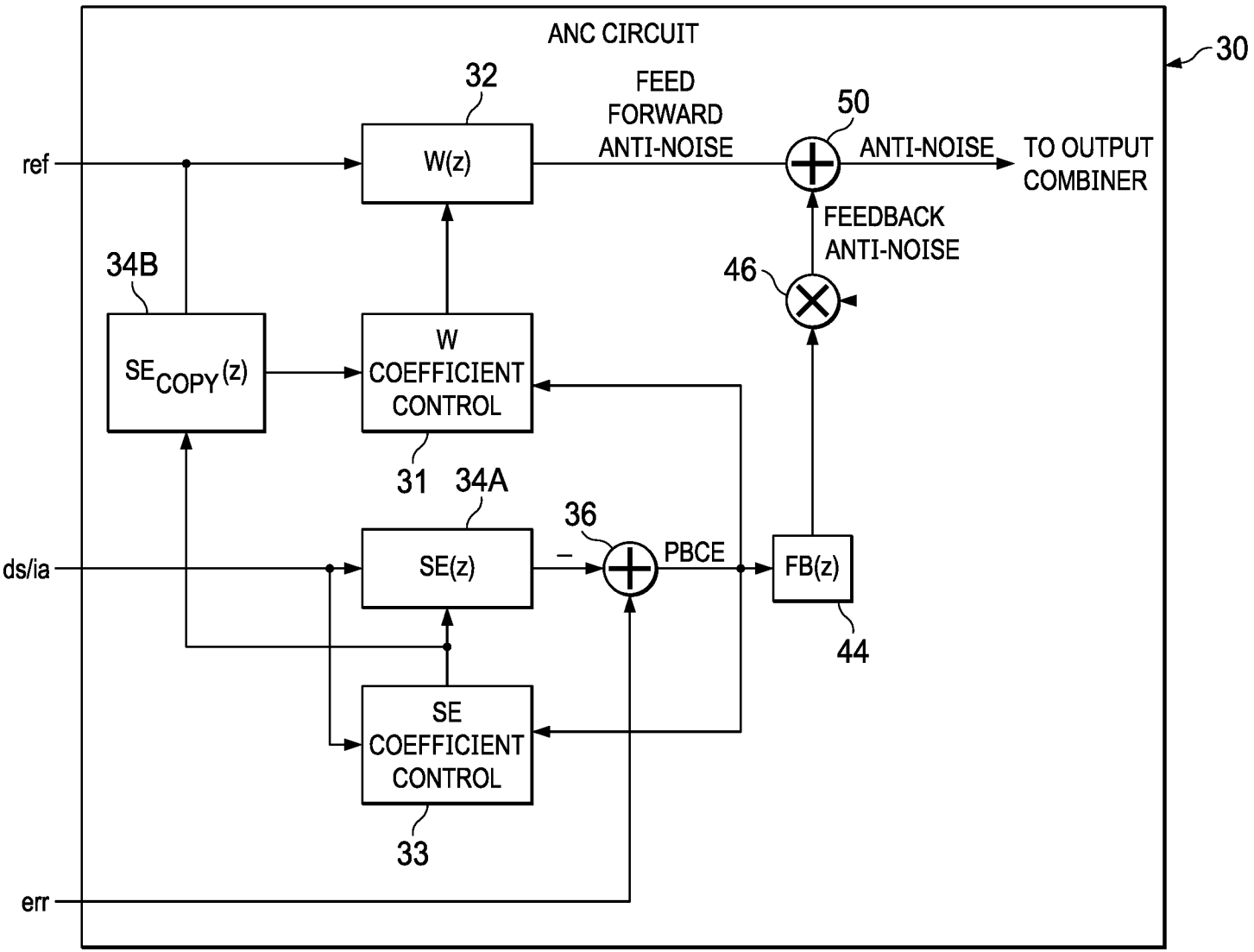
FIG. 3 is a block diagram depicting selected signal processing circuits and functional blocks within an example ANC circuit of a coder-decoder (CODEC) integrated circuit of FIG. 2 which uses feedforward filtering to generate an anti-noise signal, in accordance with embodiments of the present disclosure.

Referring now to FIG. 3, details of ANC circuit 30 which may be used to implement ANC circuit 30 are shown in accordance with embodiments of the present disclosure. Adaptive filter 32 may receive reference microphone signal ref and under ideal circumstances, may adapt its transfer function W(z) to be P(z)/S(z) to generate a feedforward anti-noise component of the anti-noise signal, which may be combined by combiner 50 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error, shown as PBCE in FIG. 3. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3, ANC circuit 30 may also comprise feedback filter 44. Feedback filter 44 may receive the playback corrected error signal PBCE and may apply a response FB(z) to generate a feedback signal based on the playback corrected error. Also as depicted in FIG. 3, a path of the feedback anti-noise component may have a programmable gain element 46 in series with feedback filter 44 such that the product of response FB(z) and a gain of programmable gain element 46 is applied to playback corrected error signal PBCE in order to generate the feedback anti-noise component of the anti-noise signal. The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

Although feedback filter 44 and gain element 46 are shown as separate components of ANC circuit 30, in some embodiments, some structure and/or function of feedback filter 44 and gain element 46 may be combined. For example, in some of such embodiments, an effective gain of feedback filter 44 may be varied via control of one or more filter coefficients of feedback filter 44. To the extent that gain element 46 has variable gain, feedback filter 44 in combination with gain element 46 may be considered an adaptive filter wherein the gain of gain element 46 is analogous to filter coefficients of feedback filter 44.

In operation, one or more of adaptive filter 32, adaptive filter 34A, adaptive filter 34B, and feedback filter 44 may be implemented with an IIR having coefficient control (e.g., by W coefficient control block 31 and/or SE coefficient control block 33) in which coefficients are selected from a library of predefined coefficients, as described in greater detail below.

Figure 4:
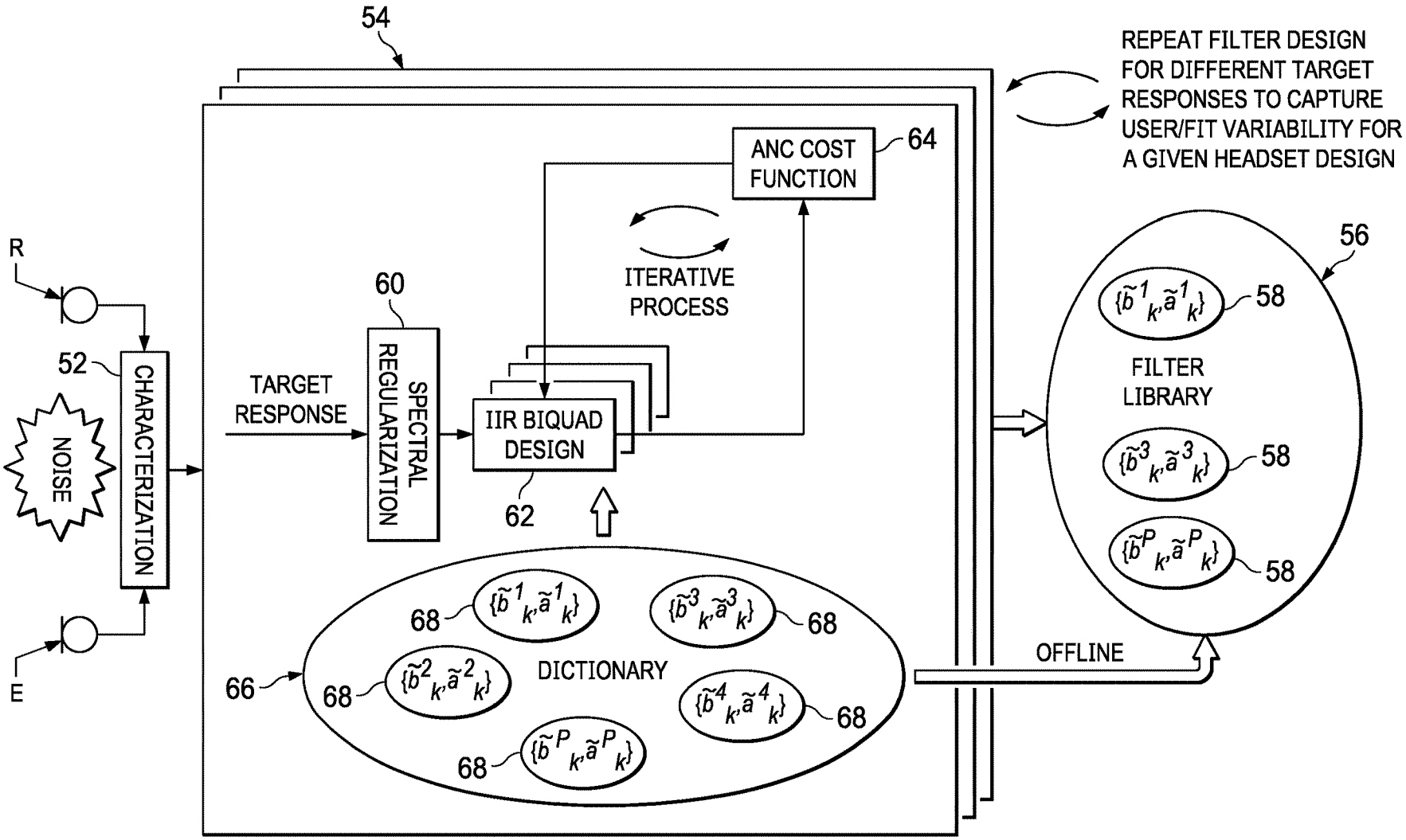
FIG. 4 is a block diagram depicting an example offline method for creating a library of IIR filter coefficients, in accordance with embodiments of the present disclosure.

FIG. 4 is a block diagram depicting an offline method (e.g., during design and production of CODEC IC 20 prior to delivery to an intended end user) for creating a library of IIR filter coefficients, in accordance with embodiments of the present disclosure. Such method may be performed in any manner, including in whole or part via a program of executable instructions executing testing and/or verification equipment for portable wireless device 10 and/or CODEC IC 20. As shown in FIG. 4, a headphone 18 may be fit into a model of a human ear, sample ambient noise may be played back and sampled by reference microphone R and error microphone E, and such ambient noise may be characterized by characterization block 52 to generate a target filter response based on the reference microphone signal and the error microphone signal in accordance with the active noise cancellation principles described above in order to minimize ambient noise received at the error microphone.

Based on the target response, a filter design block 54 may generate a filter library 56 comprising a plurality of entries 58, each entry 58 defining a set of filter coefficients associated with a filter response. In filter design block 54, a spectral regularization block 60 may first regularize the target response to ensure a filter based on the target response can be designed at a high sampling rate and with errors due to measurement limitations not resulting in ANC boosting. Such IIR filter may be decomposed into a series and/or parallel biquad structure with the coefficients of all biquads 62 being iteratively estimated by minimizing an ANC-specific cost function 64. As known in the art, each biquad 62 may represent a ratio of two quadratic functions $$\left(\text{e.g., } \frac{b_0 + b_1^{z^{-1}} + b_2^{z^{-2}}}{1 + a_1^{z^{-1}} + a_2^{z^{-2}}}\right).$$

In some embodiments, at a given iteration, coefficients of each biquad 62 may be individually optimized while other biquad coefficients may remain unchanged. In the same interaction, all individual biquads may be optimized while keeping all other biquad coefficients at a previously-optimized state. Such process may be repeated for a predetermined number of iterations. At every iteration, the biquad coefficients may be selected from a dictionary 66 that may be carefully optimized to include entries 68.

For example, dictionary 66 may be carefully optimized by limiting entries 68 to only ANC-specific poles and zeros that span only a small part of the full pole/zero domain. Poles and zeros may be constrained to be below a certain frequency, and zeros may be allowed near a Nyquist frequency in order to have a low-pass frequency response. Further, entries 68 may be limited such that the poles and zeros are either real or occur in complex pairs to ensure real filter coefficients. In ANC applications, the adaptive ANC filter need not be minimum phase, and thus entries 68 may include zeros outside the unit circle for better phase matching. However, stability may be maintained by ensuring poles of entries 68 lie only within the unit circle. In these and other embodiments, a search process may be optimized by ensuring that entries 68 are constrained to those having poles and zeros generally in the vicinity of one another. In these and other embodiments, entries 68 may be limited such that generated filter coefficients do not create quantization problems when implemented with fixed-point processing.

Each entry 68 may define a set of filter coefficients associated with a filter response, wherein such filter coefficients are pertinent to match ANC specific target responses. In these and other embodiments, each entry 68 may be parameterized by coefficients, pole/zero locations, filter type, filter cutoff frequency, bandwidth, quality factor, and/or another suitable parameter.

The biquad filter coefficients may be initialized before the iterative optimization step with a delta function or using existing methods (e.g., Steiglitz-McBride, Prony, etc.) that coarsely match the target response. The filter design having the lowest ANC cost function may be selected and stored as an entry in filter library 56.

The process performed by filter design block 54 may be repeated for different models of human ears and/or for different degrees of fit between headphone 18 and each of one or more different models, thus creating a library of entries 58, wherein each entry 58 represents a filter response. Thus, in online operation (e.g., during intended end use) of ANC circuit 30, filter library 56 may be stored in a memory integral to or otherwise accessible to ANC circuit 30, and a coefficient control block (e.g., W coefficient control 31, SE coefficient control 33), may control coefficients of an adaptive filter (e.g., adaptive filter 32, adaptive filter 34A, adaptive filter 34B) by adaptively selecting the entry 58 which minimizes the presence of ambient noise present at error microphone E, in accordance with the active noise cancellation principles described above.

Figure 5:
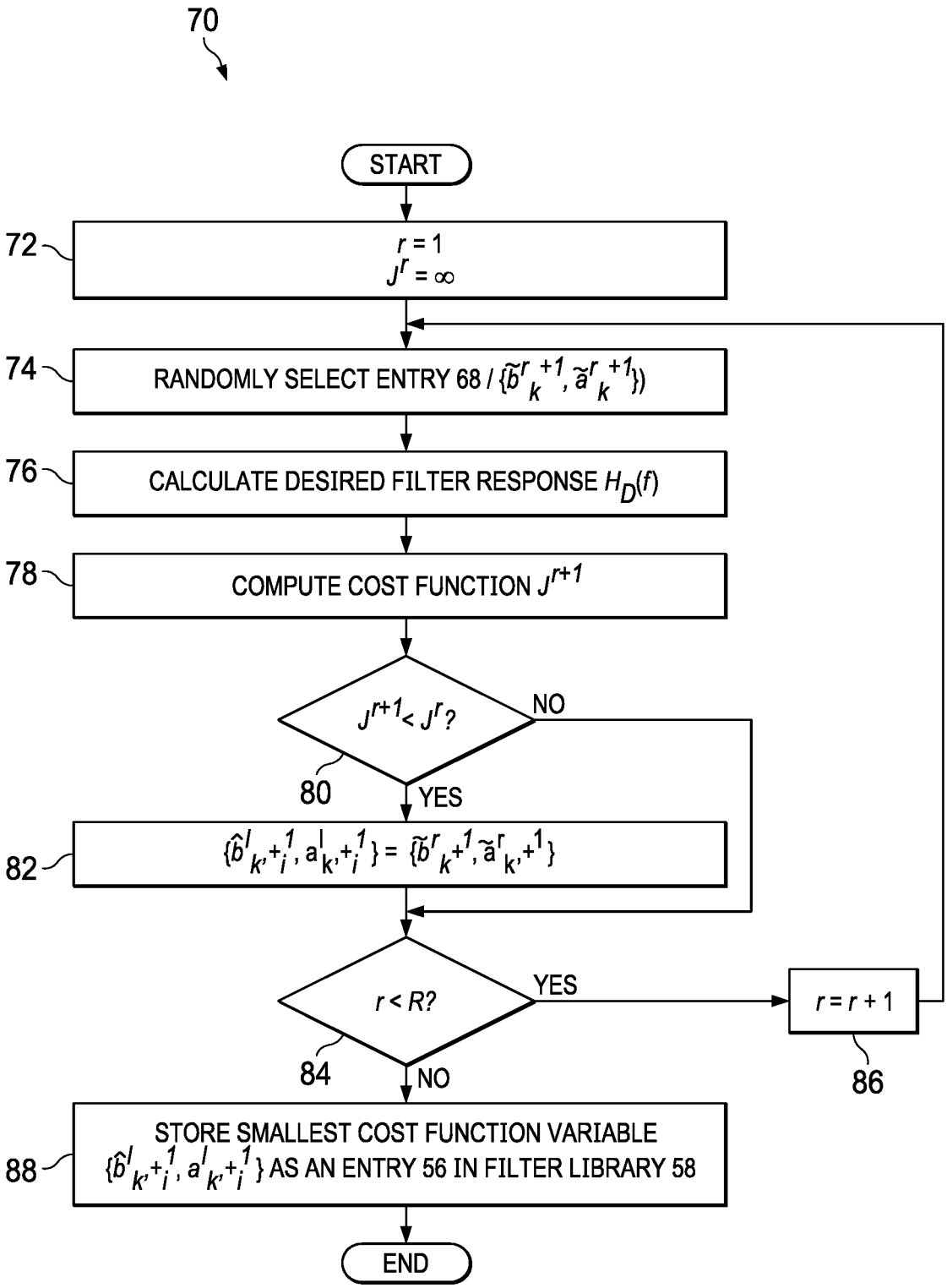
FIG. 5 is a flow chart of an example offline method for selecting an optimal biquad coefficient in a given iteration, in accordance with embodiments of the present disclosure.

Functionality of filter design block 54 may be illustrated in greater detail in FIG. 5. FIG. 5 is a flow chart of an example offline method 70 for selecting an optimal biquad coefficient in a given iteration, in accordance with embodiments of the present disclosure. As noted above, teachings of the present disclosure may be implemented in a variety of configurations of personal audio device 10. As such, the preferred initialization point for method 70 and the order of the steps comprising method 70 may depend on the implementation chosen.

At step 72, filter design block 54 may initialize iterative loop parameters. For example, a counter parameter r may be initialized to 1 and a cost function $J^r$ may be initialized to ∞ or other large value.

At step 74, filter design block 54 may randomly select an entry 68 (which may be represented by a vector $\{\tilde{b}_k^{r+1}, \tilde{a}_k^{r+1}\}$) from dictionary 66 comprising P stable and causal biquad filters parameterized by $\{\tilde{b}_k^{p}, \tilde{a}_k^{p}\}$ where p=1 . . . P. At step 76, filter design block 54 may calculate a designed filter response $H_D(f)$ associated with the filter coefficients of the randomly selected entry.

At step 78, filter design block 54 may compute the cost function $J^{r+1}$ for the designed filter response $H_D(f)$. For example, a filter design cost function J may be given by:

$$J=\gamma_{IB}\|J_{IB}\|_N+\alpha_{IB}\|J_{IB}\|_\infty+\gamma_{OOB}\|J_{OOB}\|_N+\alpha_{OOB}\|J_{OOB}\|_\infty$$

in which $\gamma_{IB}\|J_{IB}\|_N+\alpha_{IB}\|J_{IB}\|_\infty$ may be considered the in-band component and $\gamma_{OOB}\|J_{OOB}\|_N+\alpha_{OOB}\|J_{OOB}\|_\infty$ may be considered the out-of-band component, and where $\gamma_{IB}$, $\alpha_{IB}$, $\gamma_{OOB}$, and $\alpha_{OOB}$ are weighting factors that adjust the contribution of individual cost functions to an overall cost function.

In-band frequency error components $\|J_{IB}\|_N$ and $\|J_{IB}\|_\infty$ may be given by:

$$\|J_{IB}\|_N=\left[\sum_{f\in\{freqPart\}} D(f)\left|\frac{H_T(f)-H_D(f)}{\beta_{lo}\,|H_T(f)|+(1-\beta_{lo})}\right|^N\right]^{1/N}$$

$$\|J_{IB}\|_\infty=\max_{f\in\{freqPart\}}\left\{D(f)\left|\frac{H_T(f)-H_D(f)}{\beta_{lo}\,|H_T(f)|+(1-\beta_{lo})}\right|\right\}$$

Similarly, out-of-band frequency error components $\|J_{OOB}\|_N$ and $\|J_{OOB}\|_\infty$ may be given by:

$$\|J_{OOB}\|_N=\left[\sum_{f\notin\{freqPart\}} D(f)\left|\frac{|H_T(f)|-|H_D(f)|}{\beta_{hi}\,|H_T(f)|+(1-\beta_{hi})}\right|^N\right]^{1/N}$$

$$\|J_{OOB}\|_\infty=\max_{f\notin\{freqPart\}}\left\{D(f)\left|\frac{H_T(f)-H_D(f)}{\beta_{hi}\,|H_T(f)|+(1-\beta_{hi})}\right|\right\}$$

where $H_T$ (f) is the target response, D(f) is a weighting function, N=1 or 2, and $\beta_{hi}$ (which may have a range from 0 to 1) may control how much spectral normalization is applied to the cost function (e.g., if $\beta_{hi}$=0, then spectral normalization is disabled; if $\beta_{hi}$=1, then spectral normalization is fully enabled). For ANC applications, one may require accurate magnitude and phase matching for the in-band frequency components and less ANC boosting in out-of-band frequency component.

Notably, boosting due to inaccurate target response may be mitigated by using a magnitude-only cost function (e.g., using magnitude error $|H_T(f)|-|H_D(f)|$) and regularizing the target response, as described above. Weighting function D(f) may control optimal ANC performance in a frequency range of interest. Normalization of $\|J_{IB}\|_\infty$ and $\|J_{OOB}\|_\infty$ may mitigate mismatches that are caused by spectral values and peaks introduced by the physical system (e.g., resonance and anti-resonance presence in an ear canal and speaker SPKR). Further, boosting due to lower magnitude target spectrum may be mitigated by spectral magnitude normalization.

At step 80, filter design block 54 may determine whether the computed cost function $J^{r+1}$ is less than loop parameter $J^r$. If $J^{r+1}<J^r$ (e.g., indicating that the cost function of such iteration is the lowest of all iterations conducted so far), method 70 may proceed to step 82. Otherwise, method 70 may proceed to step 84.

At step 82, filter design block 54 may set a smallest cost function variable $\{\tilde{b}_{k,i}^{l+1}, a_{k,i}^{l+1}\}=\{\tilde{b}_k^{r+1}, \tilde{a}_k^{r+1}\}$.

At step 84, filter design block 54 may determine whether counter variable r is lesser than a predetermined maximum counter variable R. If r<R, method 70 may proceed to step 86. Otherwise, method 70 may proceed to step 88.

At step 86, filter design block 54 may increment counter variable r. After completion of step 86, method 70 may proceed again to step 74.

At step 88, filter design block 54 may store smallest cost function variable $\{\tilde{b}_{k,i}^{l+1}, a_{k,i}^{l+1}\}$ as an entry 56 in filter library 58. After completion of step 88, method 70 may end.

Although FIG. 5 discloses a particular number of steps to be taken with respect to method 70, method 70 may be executed with greater or fewer steps than those depicted in FIG. 5. For example, probabilistic approaches such as Markov Chaon Monte Carlo or Metropolis-Hastings methods may be used that optimally selects the appropriate biquad coefficient in the probabilistic sense. In other words, these approaches may be used to select a biquad coefficient given the current statistics of other biquad coefficients using apriori probability distribution of biquad coefficients. In addition, although FIG. 5 discloses a certain order of steps to be taken with respect to method 70, the steps comprising method 70 may be completed in any suitable order.

Method 70 may be implemented using personal audio device 10 or any other system operable to implement method 70. In certain embodiments, method 70 may be implemented partially or fully in software and/or firmware embodied in computer-readable media and executable by a controller.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. An integrated circuit for implementing at least a portion of a personal audio device, comprising:

an output for providing a signal to a transducer including both a source audio signal for playback to a listener and an anti-noise signal for countering the effects of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit configured to:

implement an adaptive infinite impulse response filter having a response that generates the anti-noise signal to reduce the presence of the ambient audio sounds at the error microphone; and implement a coefficient control block that shapes the response of the adaptive infinite impulse response filter in conformity with the error microphone signal by generating coefficients that determine the response of the adaptive infinite impulse response filter in order to minimize the ambient audio sounds at the error microphone, wherein the coefficient control block selects the coefficients from a library of filter entries, each filter entry of the library of filter entries defining a respective response for the adaptive infinite impulse response filter.

2. The integrated circuit of claim 1, wherein the library of filter entries is obtained by:

providing a dictionary comprising a plurality of entries, each entry of the plurality of entries defining a corresponding filter response of a stable and causal filter; and selecting the plurality of filter entries of the library from the dictionary via an iterative search algorithm.

3. The integrated circuit of claim 2, wherein each entry of the plurality of entries in the dictionary corresponds to a biquad filter.

4. The integrated circuit of claim 3, wherein the processing circuit is further configured to, in each iteration of the iterative search algorithm, use a probabilistic approach to optimally select biquad coefficients from the plurality of entries in order to select the biquad coefficient given the current statistics of other biquad coefficients using apriori probability distribution of biquad coefficients.

5. The integrated circuit of claim 3, wherein the processing circuit is further configured to combine biquad filters to generate the response of the adaptive infinite impulse response filter to be a complex frequency response.

6. The integrated circuit of claim 2, wherein the iterative search algorithm employs a cost function that compares a target frequency response to a desired frequency response associated with the plurality of entries in the dictionary to mitigate active noise cancellation boosting by matching only a magnitude response at selected frequencies of the target frequency response and desired frequency response.

7. The integrated circuit of claim 6, wherein the target frequency response is based on offline measurements from the error microphone input and the reference microphone input.

8. The integrated circuit of claim 7, wherein the target frequency response is regularized to account for inaccurate measurement of the target frequency response.

9. The integrated circuit of any claim 6, wherein each filter entry of the library of filter entries is decomposed into a combination of biquad filters in a series architecture, parallel architecture, or combination series and parallel architecture.

10. The integrated circuit of claim 9, wherein the iterative search algorithm optimizes each biquad filter of the combination of biquad filters individually.

11. The integrated circuit of claim 1, wherein the adaptive infinite impulse response filter comprises a feedback filter that generates at least a portion of the anti-noise signal by applying the response of the adaptive infinite impulse response filter to the error microphone signal.

12. The integrated circuit of claim 1, wherein:

the adaptive infinite impulse response filter comprises a secondary path estimate filter configured to model an electro-acoustic path of the source audio signal and have a response that generates a secondary path estimate from the source audio signal; and the coefficient control block comprises a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

13. The integrated circuit of claim 1, wherein:

the adaptive infinite impulse response filter comprises a feedforward filter having a response that generates the anti-noise signal from the reference signal to reduce the presence of the ambient audio sounds heard by the listener; and the coefficient control block comprises a feedforward coefficient control block that shapes the response of the adaptive infinite impulse response filter in conformity with the error microphone signal and the reference microphone signal to minimize the ambient audio sounds at the error microphone.

14. The integrated circuit of claim 1, wherein each filter entry of the library of filter entries is parameterized by coefficients, pole-zero locations, filter type, filter cutoff frequency, bandwidth, quality factor, and/or another suitable parameter.

15. A method comprising:

generating a signal to a transducer including both a source audio signal for playback to a listener and an anti-noise signal for countering the effects of ambient audio sounds in an acoustic output of the transducer;

receiving a reference microphone signal indicative of the ambient audio sounds;

receiving an error microphone signal indicative of the output of the transducer and the ambient audio sounds at the transducer;

implementing an adaptive infinite impulse response filter having a response that generates the anti-noise signal to reduce the presence of the ambient audio sounds at the error microphone; and implementing a coefficient control block that shapes the response of the adaptive infinite impulse response filter in conformity with the error microphone signal by generating coefficients that determine the response of the adaptive infinite impulse response filter in order to minimize the ambient audio sounds at the error microphone, wherein the coefficient control block selects the coefficients from a library of filter entries, each filter entry of the library of filter entries defining a respective response for the adaptive infinite impulse response filter.

16. The method of claim 15, wherein the library of filter entries is obtained by:

providing a dictionary comprising a plurality of entries, each entry of the plurality of entries defining a corresponding filter response of a stable and causal filter; and selecting the plurality of filter entries of the library from the dictionary via an iterative search algorithm.

17. The method of claim 16, wherein each entry of the plurality of entries in the dictionary corresponds to a biquad filter.

18. The method of claim 17, further comprising, in each iteration of the iterative search algorithm, using a probabilistic approach to optimally select biquad coefficients from the plurality of entries in order to select the biquad coefficient given the current statistics of other biquad coefficients using apriori probability distribution of biquad coefficients.

19. The method of claim 17, further comprising combining biquad filters to generate the response of the adaptive infinite impulse response filter to be a complex frequency response.

20. The method of claim 16, wherein the iterative search algorithm employs a cost function that compares a target frequency response to a desired frequency response associated with the plurality of entries in the dictionary to mitigate active noise cancellation boosting by matching only a magnitude response at selected frequencies of the target frequency response and desired frequency response.

21. The method of claim 20, wherein the target frequency response is based on offline measurements from the error microphone input and the reference microphone input.

22. The method of claim 21, wherein the target frequency response is regularized to account for inaccurate measurement of the target frequency response.

23. The method of claim 20, wherein each filter entry of the library of filter entries is decomposed into a combination of biquad filters in a series architecture, parallel architecture, or combination series and parallel architecture.

24. The method of claim 23, wherein the iterative search algorithm optimizes each biquad filter of the combination of biquad filters individually.

25. The method of claim 15, wherein the adaptive infinite impulse response filter comprises a feedback filter that generates at least a portion of the anti-noise signal by applying the response of the adaptive infinite impulse response filter to the error microphone signal.

26. The method of claim 15, wherein:

the adaptive infinite impulse response filter comprises a secondary path estimate filter configured to model an electro-acoustic path of the source audio signal and have a response that generates a secondary path estimate from the source audio signal; and the coefficient control block comprises a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

27. The method of claim 15, wherein:

the adaptive infinite impulse response filter comprises a feedforward filter having a response that generates the anti-noise signal from the reference signal to reduce the presence of the ambient audio sounds heard by the listener; and the coefficient control block comprises a feedforward coefficient control block that shapes the response of the adaptive infinite impulse response filter in conformity with the error microphone signal and the reference microphone signal to minimize the ambient audio sounds at the error microphone.

28. The method of claim 15, wherein each filter entry of the library of filter entries is parameterized by coefficients, pole-zero locations, filter type, filter cutoff frequency, bandwidth, quality factor, and/or another suitable parameter.

* * * * *